US010373439B2

(12) United States Patent
Penacho et al.

(10) Patent No.: US 10,373,439 B2
(45) Date of Patent: Aug. 6, 2019

(54) SYSTEMS AND METHODS FOR PLAYING AN ELECTRONIC GAME INCLUDING MERGE AND UNMERGE OPERATIONS

(71) Applicant: Aristocrat Technologies Australia Pty Limited, North Ryde (AU)

(72) Inventors: Gary Penacho, Henderson, NV (US); Bradley John Hendricks, Las Vegas, NV (US); Lorin Santucci, North Ryde (AU); Patrick Finch, North Ryde (AU); Casey Lyle Condron, Las Vegas, NV (US); Joseph Masinter, North Ryde (AU)

(73) Assignee: Aristocrat Technologies Australia Pty Limited, North Ryde, NSW (AU)

( * ) Notice: Subject to any disclaimer, the term of this patent is extended or adjusted under 35 U.S.C. 154(b) by 0 days.

(21) Appl. No.: 15/483,647

(22) Filed: Apr. 10, 2017

(65) Prior Publication Data

US 2018/0293846 A1 Oct. 11, 2018

(51) Int. Cl.
*G07F 17/32* (2006.01)

(52) U.S. Cl.
CPC ..... *G07F 17/3267* (2013.01); *G07F 17/3213* (2013.01); *G07F 17/3246* (2013.01); *G07F 17/3288* (2013.01)

(58) Field of Classification Search
None
See application file for complete search history.

(56) References Cited

U.S. PATENT DOCUMENTS

| | | | | |
|---|---|---|---|---|
| 7,785,191 | B2 | 8/2010 | Marks et al. | |
| 8,616,953 | B2 | 12/2013 | Yi | |
| 8,932,126 | B2 | 1/2015 | Nguyen | |
| 2001/0031659 | A1* | 10/2001 | Perrie | A63F 3/00075 463/18 |
| 2002/0045474 | A1* | 4/2002 | Singer | G07F 17/32 463/20 |
| 2005/0266915 | A1 | 12/2005 | Isogai et al. | |
| 2008/0045306 | A1 | 2/2008 | Okada | |
| 2009/0082080 | A1* | 3/2009 | Bennett | G07F 17/34 463/16 |
| 2010/0029381 | A1* | 2/2010 | Vancura | G07F 17/3244 463/30 |
| 2010/0075741 | A1 | 3/2010 | Aoki et al. | |
| 2013/0310175 | A1* | 11/2013 | Fujisawa | G07F 17/3267 463/31 |
| 2016/0093141 | A1 | 3/2016 | Nelson et al. | |

* cited by examiner

*Primary Examiner* — James S. McClellan
*Assistant Examiner* — Peter J Iannuzzi
(74) *Attorney, Agent, or Firm* — Armstrong Teasdale LLP

(57) ABSTRACT

Systems, methods, and articles of manufacture for electronic gaming are disclosed. In a first aspect, the method includes generating a plurality of reel strips, where each reel strip includes a column of symbol display positions, and where each symbol display position is adjacent to at least one other symbol display position. The method further includes selecting a first plurality of symbol display positions, displaying a symbol in each of the selected first plurality of symbol display positions, evaluating each of the selected first plurality of symbol display positions, merging, based upon the evaluating, at least two adjacent symbol display positions of the selected first plurality of symbol display positions, generating a game outcome based upon the merging, and generating a game award based upon the game outcome.

21 Claims, 13 Drawing Sheets

SYSTEMS AND METHODS FOR PLAYING AN ELECTRONIC GAME INCLUDING MERGE AND UNMERGE OPERATIONS

BACKGROUND

The subject matter of the present disclosure relates to electronic gaming, and more particularly to methods of playing an electronic game including merge and unmerge operations.

At least some gaming machines are configured to present a bonus game in response to the occurrence of a bonus condition or bonus trigger in a base, or primary, game. Specifically, a player may qualify for a bonus game based upon one or more base game outcomes. A bonus game may be played in accordance with rules that are different from the rules of the base game, and prizes or awards generated during the bonus game may be different from prizes and awards generated during the base game.

As the number and variety of available gaming systems increases, gaming systems operators, such as casinos, continue to strive for the design and implementation of new and exciting gaming systems. The present disclosure is therefore directed to such gaming systems. In particular, the present invention is directed to gaming systems and methods in which a plurality of adjacent symbol display positions may be merged and/or unmerged.

BRIEF DESCRIPTION

Systems, methods, and articles of manufacture for electronic gaming are disclosed. In a first aspect, a method of electronic gaming using a gaming system is provided. The gaming system includes a display configured to display a wagering game, a player input interface, a credit input mechanism including at least one of a card reader, a ticket reader, a bill acceptor, and a coin input mechanism, the credit input mechanism configured to establish a credit balance that is increasable and decreasable based on wagering activity, a tangible, non-transitory, computer-readable memory, and a game controller communicatively coupled to the memory.

The method includes generating a plurality of reel strips that each include a column of symbol display positions that are each positioned adjacent at least one other symbol display position. The method further includes selecting a first plurality of symbol display positions, displaying a symbol in each of the selected first plurality of symbol display positions, evaluating each of the selected first plurality of symbol display positions, merging, based upon the evaluating, at least two adjacent symbol display positions of the selected first plurality of symbol display positions, generating a game outcome based upon the merging, and generating a game award based upon the game outcome.

In another aspect, an electronic gaming system is provided. The electronic gaming system includes a display configured to display a wagering game, a player input interface configured to receive a player input, a credit input mechanism including at least one of a card reader, a ticket reader, a bill acceptor, and a coin input mechanism, the credit input mechanism configured to receive a credit wager, the credit wager initiating play of the wagering game, a game controller for controlling the wagering game, and a tangible, non-transitory, computer-readable storage medium having instructions stored thereon.

The game controller executes the instructions stored on the storage medium to perform operations including generating a plurality of reel strips that each include a column of symbol display positions that are each positioned adjacent at least one other symbol display position. The game controller further executes the instructions stored on the storage medium to perform operations including selecting a first plurality of symbol display positions, displaying a symbol in each of the selected first plurality of symbol display positions, evaluating each of the selected first plurality of symbol display positions, merging, based upon the evaluating, at least two adjacent symbol display positions of the selected first plurality of symbol display positions, generating a game outcome based upon the merging, and generating a game award based upon the game outcome.

In yet another aspect, an article of manufacture including a non-transitory, tangible, computer readable storage medium having instructions stored thereon that, in response to execution by a game controller configured for electronic gaming, cause the game controller to perform operations including generating a plurality of reel strips that each include a column of symbol display positions that are each positioned adjacent at least one other symbol display position. The game controller further executes the instructions stored on the storage medium to perform operations including selecting a first plurality of symbol display positions, displaying a symbol in each of the selected first plurality of symbol display positions, evaluating each of the selected first plurality of symbol display positions, merging, based upon the evaluating, at least two adjacent symbol display positions of the selected first plurality of symbol display positions, generating a game outcome based upon the merging, and generating a game award based upon the game outcome.

BRIEF DESCRIPTION OF THE DRAWINGS

An exemplary embodiment of the subject matter disclosed will now be described with reference to the accompanying drawings.

DETAILED DESCRIPTION

Exemplary embodiments of the present disclosure relate to systems, methods, and articles of manufacture for an electronic game, such as, for example, an electronic bonus game provided as a result of a base game outcome. A game or bonus game is facilitated in which a plurality of symbol display positions are selected, evaluated, merged, and/or unmerged to generate an optimal and/or maximum game outcome and/or game award. Selected symbol display positions may be merged with and/or unmerged from other, adjacent, selected symbol display positions during gameplay, to facilitate an optimal and/or maximum game award being represented or displayed during gameplay.

The present disclosure may be implemented in various configurations for gaming machines, including but not limited to: (1) a gaming machine in which the computerized instructions for controlling one or more games are stored within the gaming machine prior to delivery to a gaming establishment; and/or (2) a changeable gaming machine in which the computerized instructions for controlling one or more games are subsequently downloaded to the gaming machine through a data network after the gaming machine is installed within in a gaming establishment.

In an exemplary embodiment, the computerized instructions for controlling one or more games may be executed by a server, such as, for example, a central controller or remote host. In such a "thin client" architecture, the server may remotely control one or more games, or other suitable interfaces, via a gaming network, and the gaming machine may be used to display the games, or suitable interfaces, and to receive inputs or commands from a player.

In another exemplary embodiment, the instructions for controlling one or more games are communicated from a server to a local processor and memory coupled within a gaming machine. In such a "thick client" architecture, a processor of the gaming machine may execute the communicated instructions to control the game or games and/or other suitable interfaces provided to a player.

In another exemplary embodiment, one or more gaming machines within a gaming machine network may utilize a thin client architecture and one or more gaming machines within a gaming machine network may utilize a thick client architecture. Similarly, in various exemplary embodiments, certain functions of a particular gaming machine may be implemented in a thin client architecture and certain other functions of the gaming machine may be implemented in a thick client architecture. For instance, instructions for controlling a game or games may be communicated from a server to one or more network gaming machines operating in a thick client configuration, while instructions for controlling any secondary games or bonus gaming functions may executed by the server in a thin client configuration.

Figure 1:
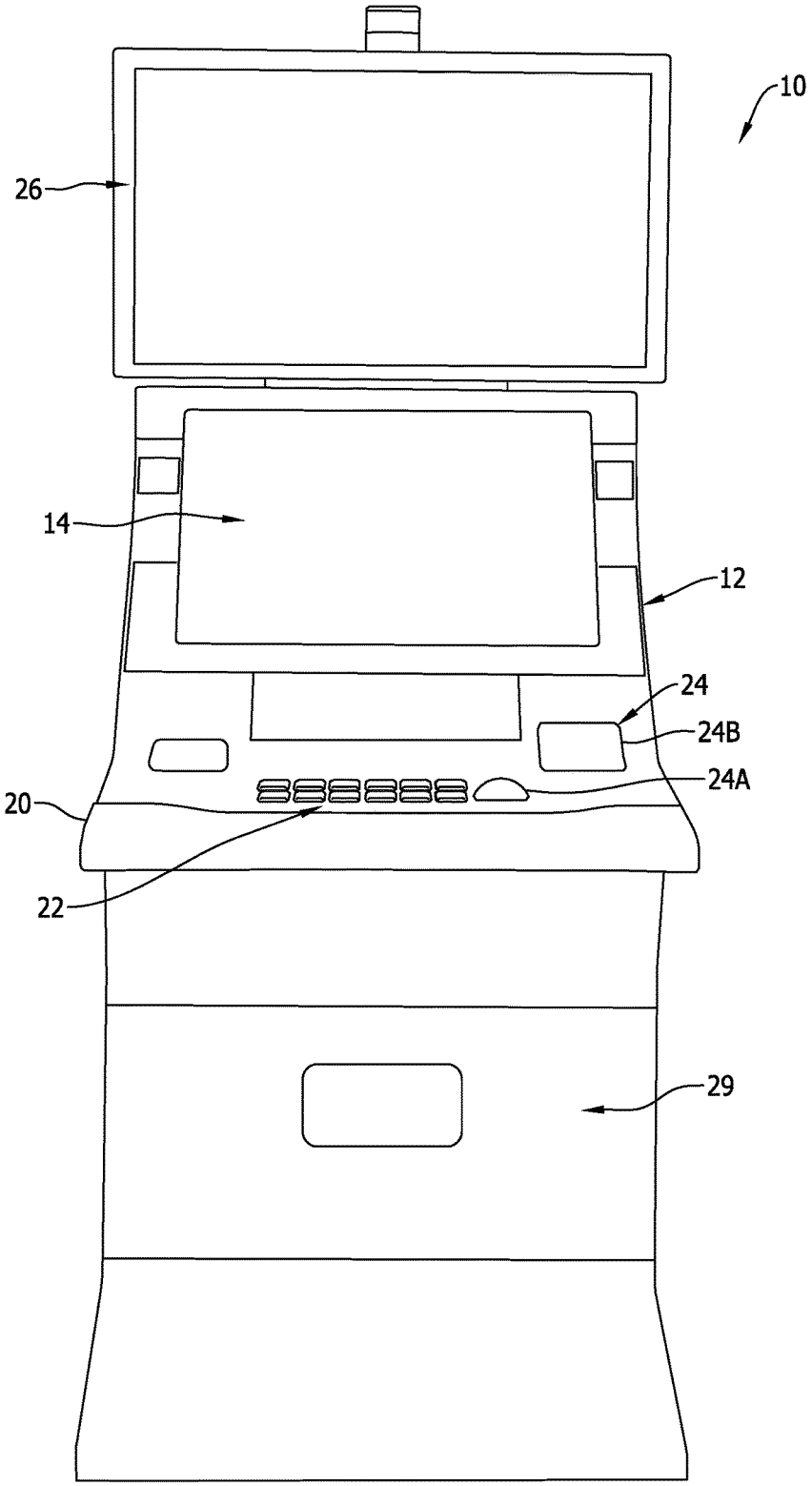
FIG. 1 is a block diagram of exemplary components of a gaming machine.

FIG. 1 is a perspective view of an exemplary gaming machine 10. Gaming machine 10 may include a support structure, housing, console or cabinet 12 that provides support for a plurality of interface units, displays, inputs, controls and other features of a conventional gaming machine. Gaming machine 10 may be configured so that a player can operate it while standing or sitting. Moreover, gaming machine 10 may be positioned on a base or stand, or can be configured as a pub-style table-top game (not shown) that a player can operate while seated. Gaming machine 10 may include varying numbers and styles of cabinets 12, display configurations, and the like without departing from the scope of the present disclosure.

In an exemplary embodiment, gaming machine 10 may include a display 14. Gaming machine 10 may further include a mid-trim 20, which may house a bank of buttons 22 for enabling a player to interact with gaming machine 10 and/or a credit input mechanism 24.

Gaming machine 10 may also include a player marketing module configured to scan or read a player tracking device, such as, for example a loyalty or player tracking card implemented within a casino as part of a loyalty program. The player tracking device may be in the form of a card, flash drive, and/or any other portable storage medium capable of being read by the reading device. In some embodiments, the player marketing module may be configured to transfer credits between gaming machine 10 and the player tracking device.

Gaming machine 10 may further include a top box 26, which may, in turn, include artwork, such as, for example, artwork depicting one or more pay tables, bonus award information, an upper display (not shown), and/or other game information or imagery. Further artwork and/or information may be provided on a front panel 29 of console 12. A coin tray 30 may be mounted beneath front panel 29 for dispensing cash payouts from gaming machine 10.

Display 14 may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In an exemplary embodiment, display 14 includes a touch-screen or touch-sensitive screen. In various embodiments, display 14 may be of any suitable size and configuration, such as any circular, square, rectangular, or other geometric configuration.

Display 14 may be further configured to provide haptic feedback. Top box 26 may also include a display, which may be of the same or different from display 14.

Display 14 may, in various embodiments, display a game and/or accept game play data from a player. Moreover, display 14 may also display information relating to an interactive game, wager triggering event, or wagering outcome. In an exemplary embodiment, an upper display (not shown) mounted in top box 26 may display any wagering outcome, any suitable secondary game associated or not associated with the interactive game, or any information relating to the interactive games. The upper display may also be configured to accept game play data from a player.

Display 14 may, in addition, serve as digital signage operable to advertise one or more games or other aspects of the gaming establishment. In an exemplary embodiment, gaming machine 10 may also include a credit or fund display 20, which may display a player's current number of credits, cash accumulated, account balance, an original number of credits the player funded the gaming machine with, or an equivalent of any of the aforementioned, and the like. Moreover, in an exemplary embodiment, display 14 may display an amount being wagered or a player's accumulated winnings.

In an exemplary embodiment, and as described in greater detail herein, display 14 may display at least one game or game image, game symbol or symbols, and game indicia, such as any visual representation or exhibition of a movement of objects, including, for example, any mechanical, virtual, or video reels and wheels, dynamic lighting, video images, images of people, characters, places, things and faces of cards, and the like. In various embodiments, the symbols, images and indicia described above may be displayed mechanically, such as by one or more mechanical or physical reels. In other words, display 14 may include any electromechanical device, such as one or more rotatable or spinning wheels, reels or dice, any of which may be configured to display at least one or a plurality of games or other suitable images, symbols or indicia.

Figure 2:
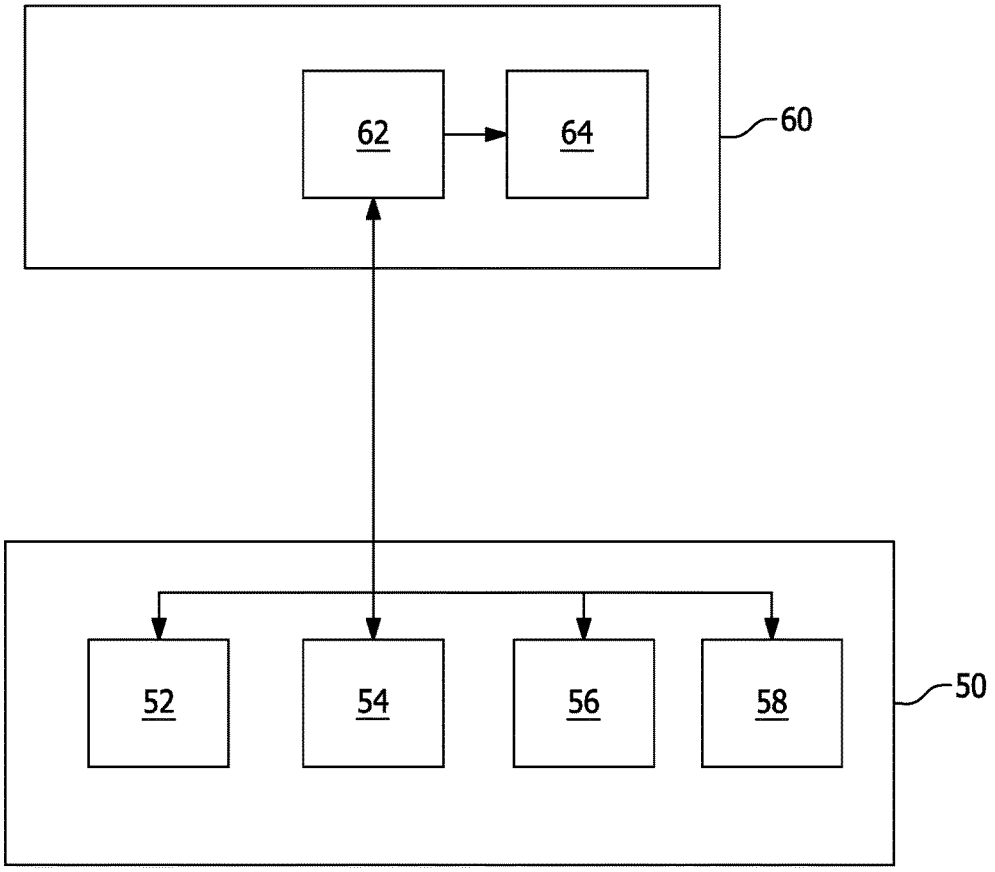
FIG. 2 is a perspective view of an exemplary gaming machine.

FIG. 2 is a block diagram of an exemplary player interface 50 and game controller 60 of gaming machine 10. Player interface 50 and game controller 60 may be housed within gaming machine 10, such as on a printed circuit board located within cabinet 12 of gaming machine 10. As described herein, player interface 50 may be arranged to enable manual interaction between a player and the gaming system and for this purpose includes various input/output components required for the player to enter instructions to play the game and observe the game outcomes.

Components of player interface 50 may include at least one credit input mechanism 24, at least one display 14, a game play mechanism 56 (including one or more input devices that enable a player to input game play instructions or place a wager), and/or one or more audio output devices 58 (e.g., one or more speakers).

Game controller 60 may be in data communication with player interface 50 and may include at least one processor 62 or other suitable controller, such as a microprocessor, a microcontroller-based platform, a suitable integrated circuit or one or more application-specific integrated circuits (ASICs). Processor 62 may be coupled in communication with, or may be operable to access or to exchange signals with, at least one data storage module or memory 64. Processor 62 may thus be configured to retrieve game play instructions from memory 64, process the game play instructions in accordance with game play rules, and output one or more game play outcomes to display 54.

Memory 64 may include any suitable tangible, non-transitory, computer-readable storage medium. Memory 64 may store program code and instructions, executable by processor 62, to control gaming machine 10. Memory 64 may also store other data, such as, for example, image data, one or more pay tables or pay table data, event data, player input data, random or pseudo-random number generators, or numbers generated by a random number of pseudo-random number generator, look-up table data, and/or information and applicable game rules that relate to the play of gaming machine 10.

Figure 3:
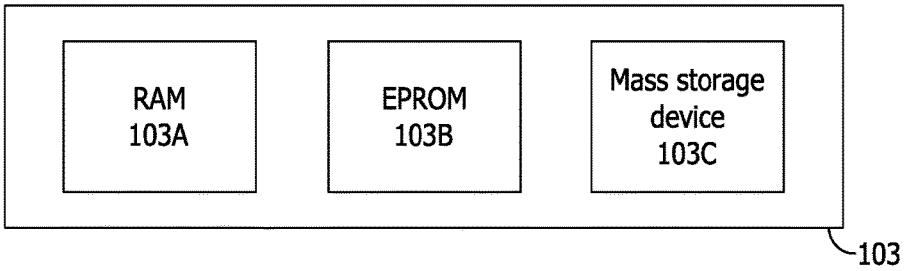
FIG. 3 is a block diagram of exemplary components of a gaming machine.

With brief attention to FIG. 3, a block diagram of memory 64 is shown. Memory 64 may, in various embodiments, include a memory 103 (as described herein with reference to FIG. 3). Memory 103 may include random access memory (RAM) 103A, such as non-volatile RAM (NVRAM), magnetic RAM (MRAM), ferroelectric RAM (FeRAM) and other forms as commonly understood in the gaming industry. Memory 103 may further include read only memory (ROM), such as EPROM 103B or electrically erasable programmable read only memory (EEPROM). Memory 64 may further include one or more mass storage devices 103C, such as one or more hard drives, one or more solid state or flash memory components, one or more CD and/or DVD drives, and the like. Any other suitable magnetic, optical, and/or semiconductor memory may be used to operate in conjunction with gaming machine 10 that enables gaming machine 10 to function as described herein.

In an exemplary embodiment, RAM 103A may temporarily store one or more program files (and/or other related data) for execution by processor 62. EPROM 103B may include a boot ROM device and/or may contain some system or game related code. Mass storage device 103C may store one or more game programs, the integrity of which may be verified and/or authenticated by the processor 62 through the use of protected or encrypted code stored, for example, on EPROM 103B.

In various embodiments, part or all of the program code and/or operating data described above is stored in a detachable or removable memory, including, but not limited to, a suitable cartridge, disk, CD ROM, DVD or USB memory device. In addition, in various embodiments, all or part of the program code and/or operating data described above may be downloadable to memory 64 by way of any suitable computer network.

In an exemplary embodiment, a desktop computer, a laptop personal computer, a personal digital assistant (PDA), a smartphone, a tablet computing device or other portable computing device, and/or any other computerized platform may implement the computing operations of the present disclosure. For example, any suitable mobile computing device, such as any smartphone or tablet computing device, may implement and enable gameplay as described herein. It should be appreciated that each gaming machine 10 disclosed herein may include a device that has obtained approval from a regulatory gaming commission or a device that has not obtained approval from a regulatory gaming commission. It should also be appreciated that processor 62 and memory 64 may be collectively referred to herein as a "computer" or "controller."

Returning to FIG. 1, in an exemplary embodiment, credit input mechanism 24 may be coupled in communication with processor 62. Credit input mechanism 24 may include any suitable credit input mechanism or device, such as a coin input chute 24A, a bill or ticket collector 24B, and the like. Credit input mechanism may be configured to receive any suitable monetary credit, such as money, coins, tokens, tickets, and the like. In various embodiments, credit input mechanism 24 may further include card reader devices, such as credit or debit card readers or validators for credit cards, debit cards, printed ticket printers and/or readers, and the like.

In various embodiments, a player may insert an identification card (not shown) into a card reader of gaming machine 10. The identification card may be a smart card that includes a programmed microchip or a magnetic strip coded with a player's identification, credit totals (or related data) and other relevant information. A player may further carry a portable device, such as a cell phone or smart phone, a radio frequency identification tag or any other suitable wireless communication device, which communicates a player's identification, credit totals (or related data) and other relevant information to gaming machine 10. In an embodiment, money may be transferred to gaming machine 10 via an electronic funds transfer process. When a player funds gaming machine 10, processor 62 may determine an amount of funds entered and display the corresponding amount on the display 14.

Game play mechanism 56 may include at least one input device that is coupled in communication with processor 62. An input device may include any device that enables a player to produce an input signal that is receivable by processor 62. For example, in one embodiment, after funding gaming machine 10, the input device may include a game activation device, such as a pull arm or one or more play button 22 that enables the player to start the game or a sequence of events in gaming machine 10. Play button 22 may include any suitable play activator such as a bet one button, a max bet button, or a repeat the bet button. In an embodiment, after appropriate funding of gaming machine 10, game play may begin automatically.

In an exemplary embodiment, one input device may include a "Bet One" button. A player may place a wager or bet by pushing the Bet One button and may increase the wager by repeatedly depressing or selecting the Bet One button. In various embodiments, an input device includes a "Bet Max" button that enables a player to place a maximum wager permitted during a particular game or game session.

In various embodiments, an input device may also include a "Cash Out" button. A player may depress or select a Cash Out button to receive a cash payment or other suitable form of payment corresponding to the number of credits remaining. In an embodiment, when the player cashes out, the player receives coins or tokens in a coin payout tray. A player may further receive tickets or credit slips, or the player's electronically recordable identification card may be funded, in response to selection of a Cash Out button.

In various embodiments, an input device may include a touch-screen that is coupled to a touch-screen controller, or some other touch-sensitive display overlay, to enable player interaction with images presented on display 14. A touch-screen and/or touch-screen controller may be communicatively coupled to a video controller, such that a player may provide input signals to gaming machine 10 by physically manipulating or interacting with the touch-screen.

Gaming machine 10 may include a sensor, such as a camera (not shown) coupled in communication with processor 62. The camera may, in various embodiments, be controlled by processor 62, such that a player may direct the orientation and focus of the camera to acquire an image of a player actively playing gaming machine 10 and/or a surrounding area of gaming machine 10. In an exemplary embodiment, the camera may selectively acquire still or moving (e.g., video) images and may be configured to acquire the images in either an analog, digital, or other suitable format. Display 14 may be configured to display the image acquired by the camera, as well as to display the visible manifestation of the game in split screen or picture-in-picture fashion. For example, the camera may acquire an image of the player and processor 62 may incorporate that image into the interactive and/or secondary game as a game image, symbol or indicia.

Figure 4:
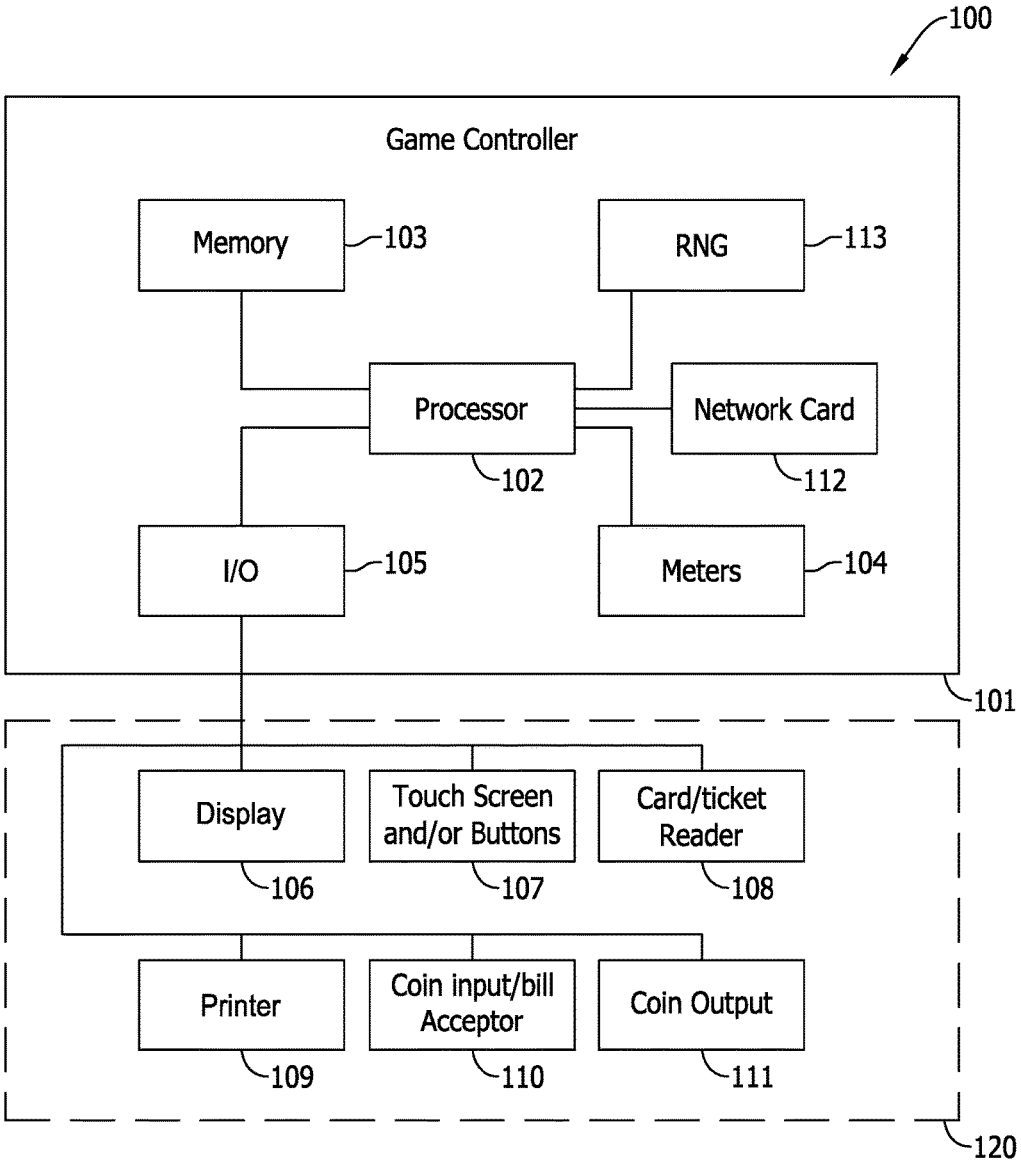
FIG. 4 is a schematic diagram of exemplary components of a memory.

FIG. 4 illustrates a more detailed block diagram of various exemplary functional components of a gaming machine 100, which may be the same as or different from gaming machine 10 (as shown in FIG. 2). The foregoing description of components (e.g., display 14, player interface 50, and game controller 60) may therefore apply to the description of similar components in gaming machine 100. For instance, processor 62 may be the same as or different from 102, as described below. Similarly, memory 64 may be the same as or different from memory 103 as described below.

Accordingly, gaming machine 100 may include a game controller 101 (which may include a processor 102 mounted on a circuit board, as described in greater detail above). Instructions and data to control operation of processor 102 may be stored in a memory 103 that is in data communication with processor 102. Gaming machine 100 may include both volatile and non-volatile memory and more than one of each type of memory, with such memories being collectively represented by memory 103.

Gaming machine 100 may further include hardware meters 104 (to ensure regulatory compliance and to monitor player credit) and/or an input/output (I/O) interface 105 (for communicating with peripheral devices of gaming machine 100). Input/output interface 105 and/or the peripheral devices may include intelligent devices with their own memory for storing associated instructions and data. A random number generator module 113 may generate random numbers for use by processor 102. Persons skilled in the art will appreciate that random number generator module 113 includes a pseudo-random number generator.

In an exemplary embodiment, a player interface 120 includes peripheral devices that communicate with game controller 101 including one or more displays 106, a touch screen and/or input buttons 107 (which provide a game play mechanism), and a credit input mechanism, such as a card and/or ticket reader 108, a printer 109, a bill acceptor and/or coin input mechanism 110, and a coin output mechanism 111. The credit input mechanism is configured to receive a credit wager to initiate play of a base game, and establish a credit balance (e.g., using the received credit wager) that is increasable and decreasable based on wagering activity within a game. Player interface 120 also includes a payout mechanism such as a printer 109 and/or a coin output mechanism 111. The payout mechanism is configured to output a payout to a player of gaming machine 100 based on an outcome of the game (e.g., a base game and/or a feature game).

Additional hardware may be included as part of gaming machine 100, or hardware may be omitted as required for the specific implementation. For example, although buttons or touch screens are typically used in gaming machines to allow a player to place a wager and to initiate a play of a game any input device that enables the player to input game play instructions may be used. For example, in some gaming machines a mechanical handle may be used to initiate a play of the game. Persons skilled in the art will also appreciate that a touch screen can be used to emulate other input devices, such as, for example, a touch screen that can display virtual buttons that a player can "press" by touching the screen where they are displayed.

In addition, gaming machine 100 may include a communications interface, such as, for example a network card 112. Network card 112 may, for example, send status information, accounting information and/or other information to a bonus controller, central controller, server or database and receive data or commands from the bonus controller, central controller, an/or server or database. In various embodiments (e.g., embodiments that employ a player marketing module), communications over a network may be via the player marketing module—e.g., the player marketing module may be in data communication with one or more of the above devices.

In various embodiments, components of gaming machine 100 may be distributed. For example, in an embodiment, input/output devices 106, 107, 108, 109, 110, and 111 may be provided remotely from game controller 101.

Figure 5:
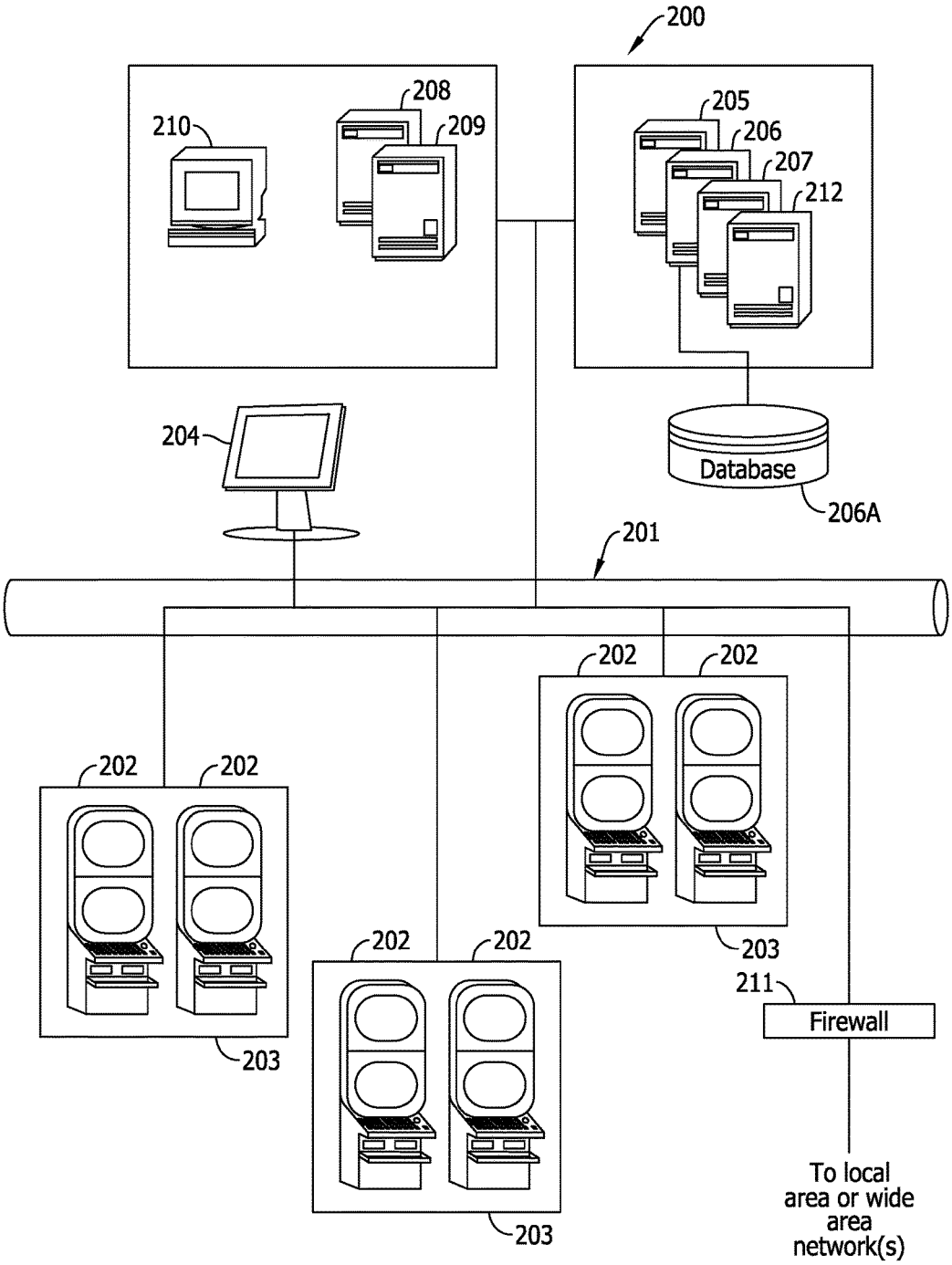
FIG. 5 is a schematic diagram of an exemplary network gaming system.

FIG. 5 illustrates such an exemplary distributed gaming system 200. Gaming system 200 may include a network 201, which, for example, may include a wired or wireless network, such as a Wi-Fi or BLUETOOTH network, an Ethernet network, an RS-232 network, and/or any combination thereof. In an exemplary embodiment, gaming machines 202, shown arranged in three banks 203 of two gaming machines 202, are connected to network 201. Gaming machines 202 may provide a player operable interface and may be the same as (or substantially similar to) the gaming machines 10 and 100 (as shown in FIGS. 2 and 3), or may have simplified functionality depending, for example, on various game play requirements.

One or more displays 204 may also be connected to network 201. For example, displays 204 may be associated with one or more banks 203 of gaming machines. Displays 204 may be used to display representations associated with game play on gaming machines 202 and/or used to display other representations, such as, for example promotional or informational material. Displays 204 may be the same as or substantially similar to display 14, as described above.

In a thick client embodiment, game server 205 may implement part of the game played by a player using gaming machine 202, and gaming machine 202 may implement part of the game. In such an embodiment, insofar as both game server 205 and gaming machine 202 may implement part of the game, they may collectively include a game controller. A database management server 206 may manage storage of game programs and associated data for downloading or access by gaming machines 202 in a database 206A. Typically, if gaming system 200 enables players to participate in a jackpot game, a jackpot server 207 may be provided to perform accounting functions for the jackpot game. A loyalty program server 212 may also be provided.

In a thin client embodiment, game server 205 may implement most or all of the game played by a player using gaming machine 202, and gaming machine 202 may, in essence, function provide little more than the player interface. In such an embodiment, game server 205 may include the game controller. Gaming machine 202 may thus receive player instructions and transmit those instructions to game server 205. Further, in a thin client embodiment, gaming machines 202 may be computer terminals, such as, for example, personal computers, laptop computers, tablet computing devices, smartphones, and the like running software that provides a player interface. Other client/server configurations are contemplated and are within the scope of this disclosure. Additional details of a client/server architecture may be found in WO 2006/052213 and PCT/SE2006/000559, the disclosures of which are incorporated herein by reference in their entireties.

One or more servers may be provided to assist in the administration of gaming system 200. Such servers may include, for example, a gaming floor management server 208, and a licensing server 209 to monitor the use of licenses relating to particular games. An administrator terminal 210 may be provided to allow an administrator to run network 201 and the devices connected to network 201.

Gaming system 200 may communicate with other gaming systems and/or other local networks, such as, for example a corporate network, and/or a wide area network such as the Internet Communications may be filtered through a firewall 211.

Persons skilled in the art will appreciate that in accordance with known techniques, functionality at the server side of network 201 may be distributed over a plurality of different computers. For example, elements may be run as a single "engine" on one server or a separate server may be provided. For example, game server 205 may implement a random number generator engine. Alternatively, a separate random number generator server may be provided. Further, persons skilled in the art will appreciate that a plurality of game servers may be provided to implement different games or a single game server may implement a plurality of different games as required by the terminals.

In an exemplary embodiment, a player may place a wager using the game play mechanism 56. A game (or game session) may be initiated in response to placement of the wager, a plurality of symbols randomly drawn, and a game (or game session) outcome determined based upon the symbols drawn. A game outcome may be compared to a pay table (which may be stored in a computer memory) to determine a payout or award (also referred to herein as a win entitlement). Persons skilled in the art will appreciate that a player's wager can be varied from game to game dependent on player selections.

In various embodiments, a wager may include a selection of a number of lines to be played during a game session. Such lines may include an interconnected combination of symbol display positions. Each selected line may be evaluated to identify winning combinations of symbols. A pay table (e.g., a pay table stored in memory 64) may be referenced to identify a payout or award based upon an identified winning combination of symbols. In various embodiments, an award may be multiplied or increased by a multiplication factor as well.

In an exemplary embodiment, gaming machine 202 may generate an award that is not based solely upon a number of a lines selected. For example, "scatter" pays (e.g., randomly selected awards that are not identified based upon a plurality of adjacent symbols) may be awarded independently of a player's selection of pay lines.

Throughout this specification and in the claims, the terms "primary game" and "bonus game" refer to a game session that includes more than one game event or, simply, one or more games. The primary game may correspond to a primary or "base" game, as opposed to a bonus game, as described below. The primary game may be initiated in response to a wager or credit being received by or transferred to gaming machine 10 (shown in FIG. 1). The primary game (as well as one or more games comprising the primary game) may also be initiated by other game events including, for example, a player selecting a "spin" button, a start button, a deal button, or any other such input selector designated for initiating a game session. The primary game may be terminated voluntarily in response to an input by the player indicating that the player wishes to stop the game or automatically by the gaming device in response to a termination event, such as a zero credit balance in the reel game.

Further, as used herein, the terms "bonus game," "secondary game," and "bonus game session" refer generally to a game or a component of a game involving procedures in addition to the primary game. The bonus game may be initiated after, or during, the primary game and in response to a particular condition occurring during the primary game. The bonus game may include a plurality of bonus game events. For example, where the primary game includes a slot machine game, the bonus game may allow players a possibility of winning more than the pay table for the primary game indicates. Typically, a bonus game outcome may depend upon a particular symbol being displayed when one of a plurality of final game events takes place. In addition, the bonus game outcome may depend upon winning a payout while gaming machine 10 is in a bonus mode or "zone." In various embodiments, the outcome of the bonus game may be unrelated to the outcome of the primary game.

As used herein, the term "reel strip" may be used to refer to a column of symbol display positions. Each symbol display position may be displayed or located on a physical reel or a virtual reel. In the exemplary embodiment, gaming machine 10 may display six reel strips, each having six symbol display positions, for a total of thirty six symbol display positions. A symbol display position may further display a symbol, such as a symbol selected by game controller 60.

Figure 6:
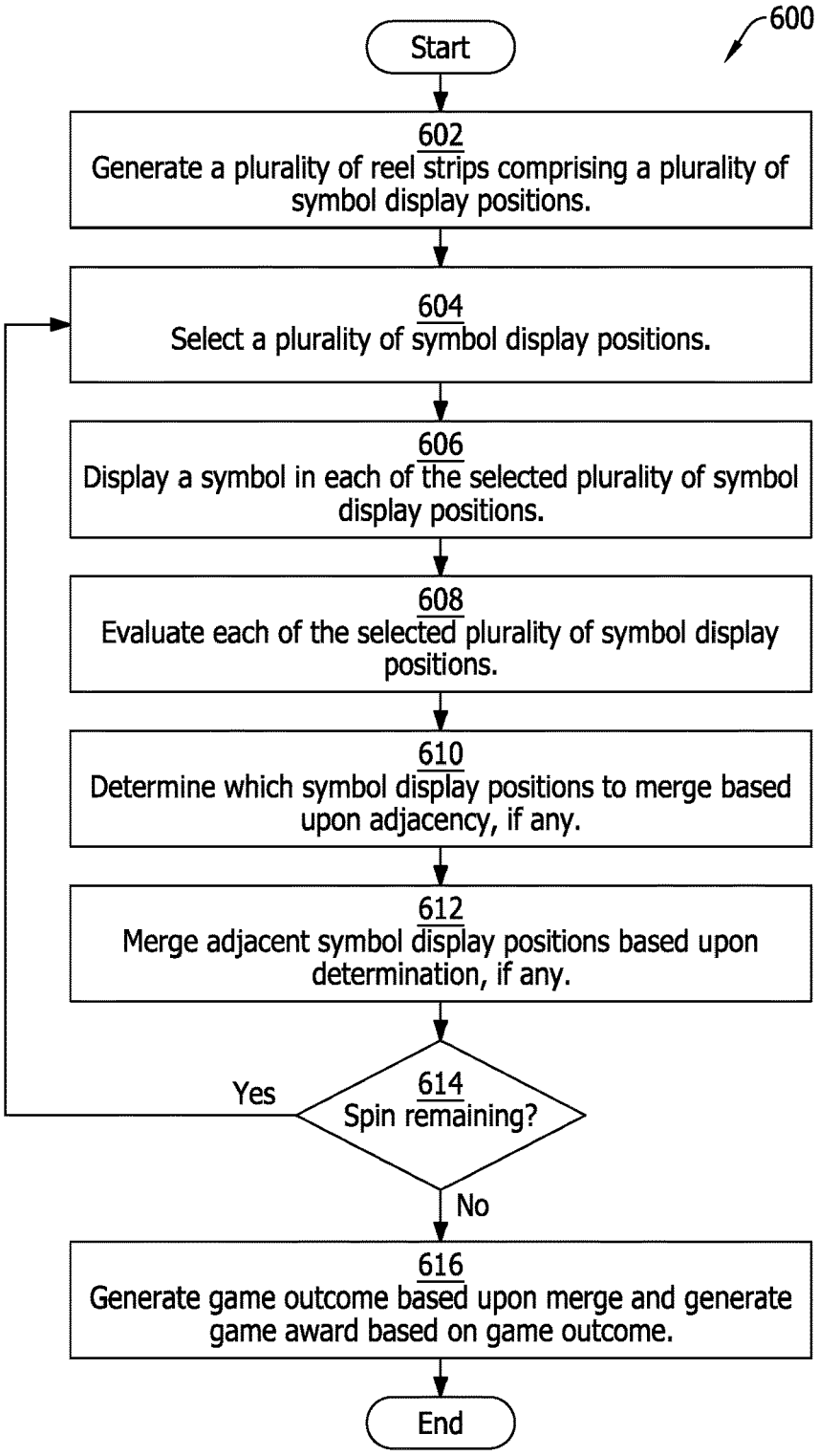
FIG. 6 is a flowchart of an exemplary method of electronic gaming.

An exemplary bonus game is described below with reference to FIGS. 6-12. Specifically, FIG. 6 is a flowchart of an exemplary method 600 of implementing an electronic bonus game, and FIGS. 7-13 are screenshots intended to illustrate gameplay. The symbol position selections described below with reference to the screenshots of FIGS. 7-13 are merely illustrative, however, and many other combinations of selected, merged, and/or unmerged symbol display positions are contemplated and within the scope of this disclosure. Thus, the exemplary gameplay described below should not be construed as limiting the scope of this disclosure but as generally illustrative of gameplay in accordance with method 600.

Figure 7:
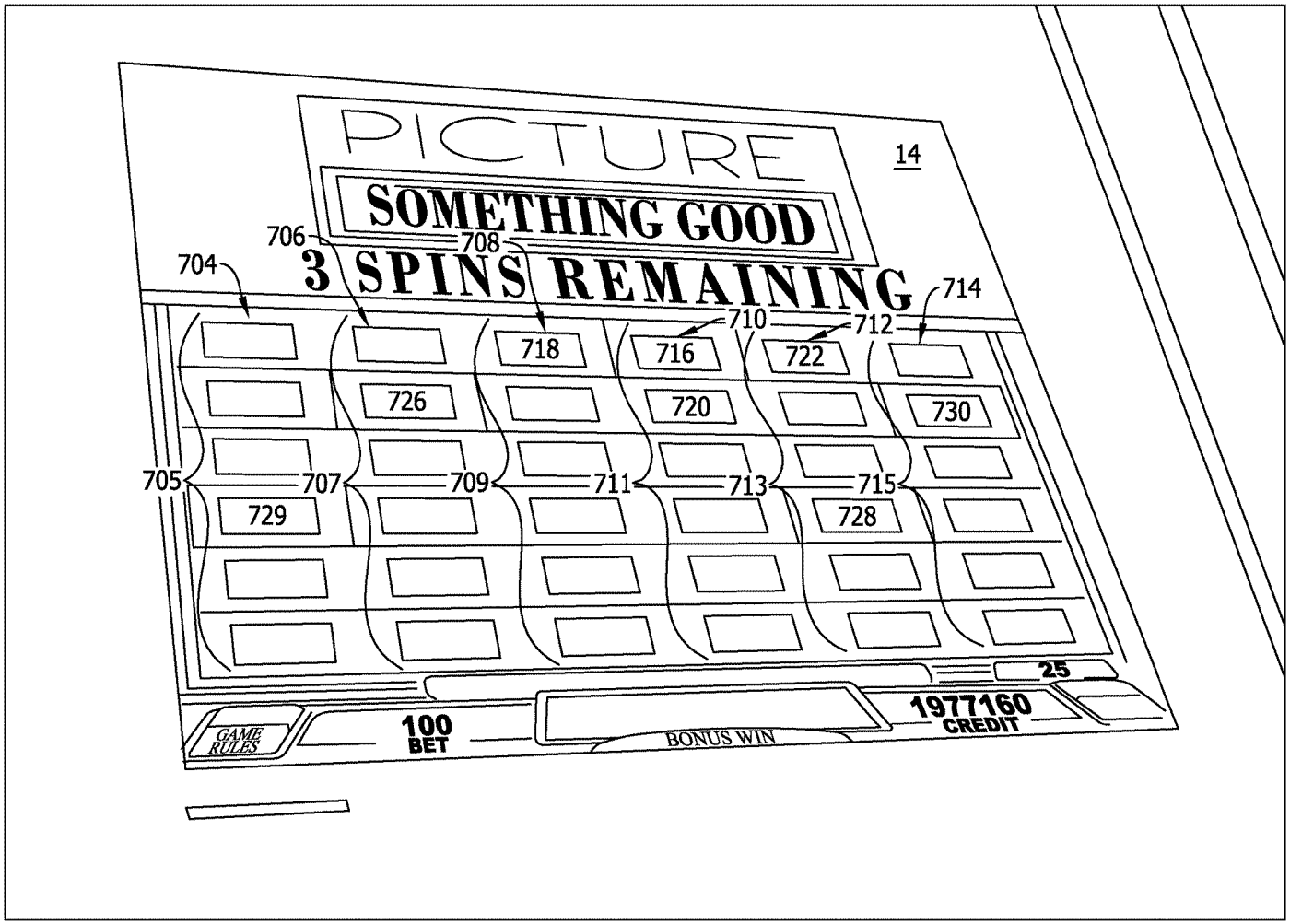
FIG. 7 is an exemplary screenshot that may be displayed in which a first plurality of symbol display positions are selected.

Accordingly, with attention now to FIGS. 6 and 7, an exemplary method 600 of electronic gaming is shown in FIG. 6 in conjunction with an exemplary screenshot 700 (shown in FIG. 7). Game controller 60 (shown in FIG. 2) may execute method 600 as part of a bonus game, which may be triggered as a result of a base game outcome. In other words, in some embodiments, method 600 may be implemented as part of a bonus game.

A player may be allocated any number of initial spins during the bonus game. For example, in some embodiments, a player may be allocated three initial spins. The player may initiate each spin using a button or other input component of game play mechanism 56. Further, in the event that game controller 60 selects at least one symbol display position (as described below) during one of the three initial spins, one or more additional spins may be added to the player's total number of bonus spins remaining, thereby increasing the duration of the bonus game implemented by method 600. In one embodiment, selection of at least one symbol display position by game controller 60 during, one of the three initial spins, adds three additional spins to the total number of spins remaining. Further, in some embodiments, each time game controller 60 selects at least one symbol display position, one or more spins may be added to the number of spins remaining. Thus, the bonus game may continue indefinitely until the player exhausts the number of spins allocated during the bonus game and/or until the player hits a jackpot award (as described below).

In the exemplary embodiment, game controller 60 may generate 602 a plurality of reel strips in response to initiation of the bonus game (such as based upon a base game outcome, as described above). Each reel strip may be displayed on a display, such as display 14 (shown in FIG. 1). For example, as shown, game controller 60 may generate six reel strips, such as reel strips 704, 706, 708, 710, 712, and 714. However, in other embodiments, game controller 60 may generate any other suitable number of reel strips.

Each reel strip 704-714 includes a plurality of symbol display positions, such as a first plurality of symbol display positions 705, a second plurality of symbol display positions 707, a third plurality of symbol display positions 709, a fourth plurality of symbol display positions 711, a fifth plurality of symbol display positions 713, and a sixth plurality of symbol display positions 715. In the exemplary embodiment, each reel strip 704-714 includes six symbol display positions. However, in other embodiments, each reel strip 704-714 may include any suitable number of symbol display positions.

Further, as shown, each symbol display position is adjacent to at least one other symbol display position. For example, symbol display position 716 is adjacent to symbol display positions 718, 720, and 722. Symbol display positions 718 and 722 are horizontally adjacent to symbol display position 716, and symbol display position 720 is vertically adjacent to symbol display position 716. The remaining symbol display positions are similarly disposed in horizontal and/or vertical alignment over display 14.

Having generated reel strips 704-714, game controller 60 may select 604 a first plurality of symbol display positions, such as, for example, symbol display positions 716, 724, 726, 728, and 730. Specifically, game controller 60 may select 604 the first plurality of symbol display positions 716 and 724-730 based upon a random number (or pseudo-random number) generated by a random number generator that is coupled to game controller 60, such as random number generator 113. Each of the selected first plurality of symbol display positions 716 and 724-730 are associated with a credit value, such as a credit value of ten credits. In various embodiments, any suitable credit value may be associated with selected symbol display positions, and each selected symbol display position may be associated with a particular credit value, or different selected symbol display positions may be associated with different credit values.

Figure 8:
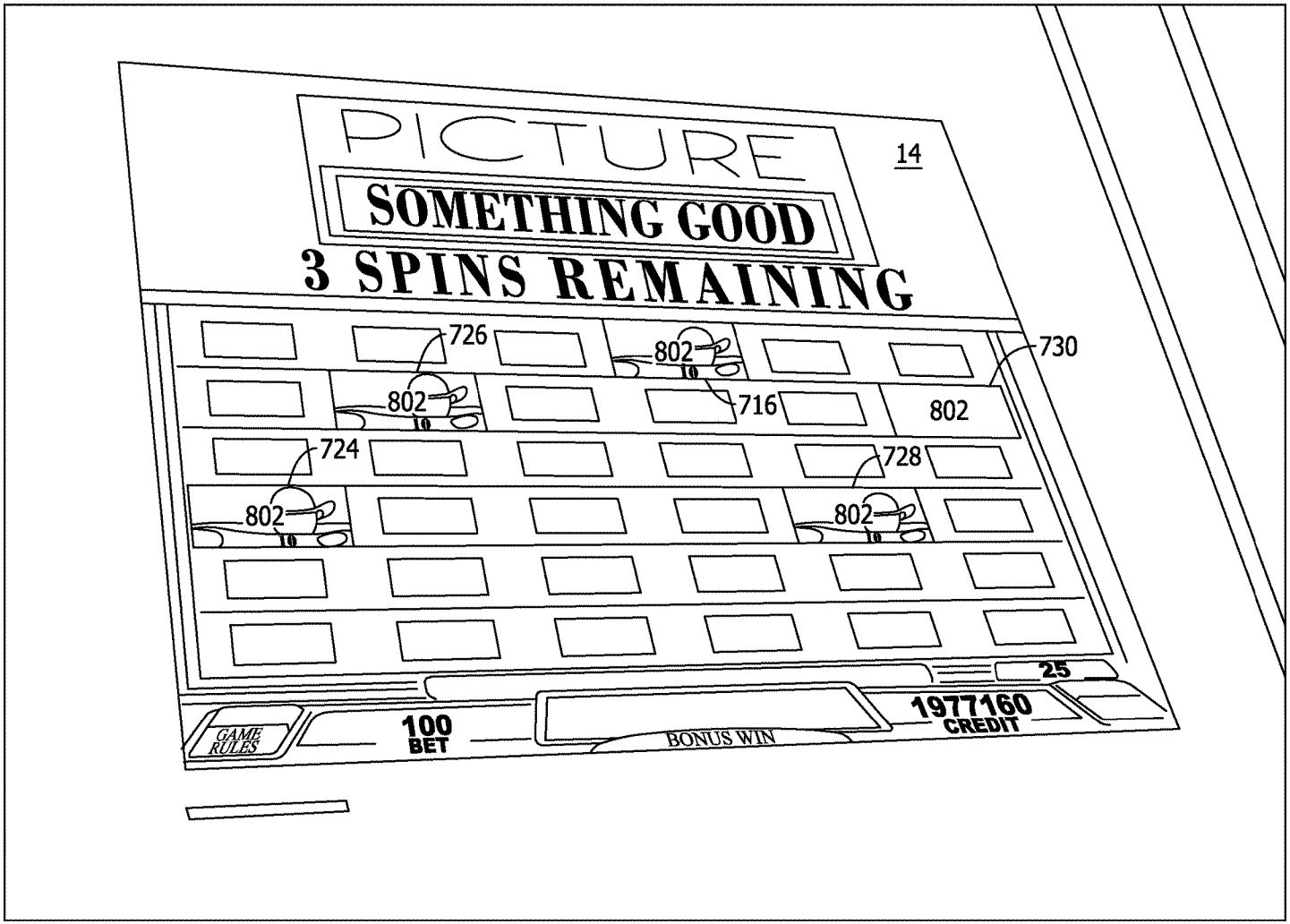
FIG. 8 is an exemplary screenshot that may be displayed in which a symbol is displayed in each of the first plurality of symbol display positions as shown at FIG. 7.
Figure 9:
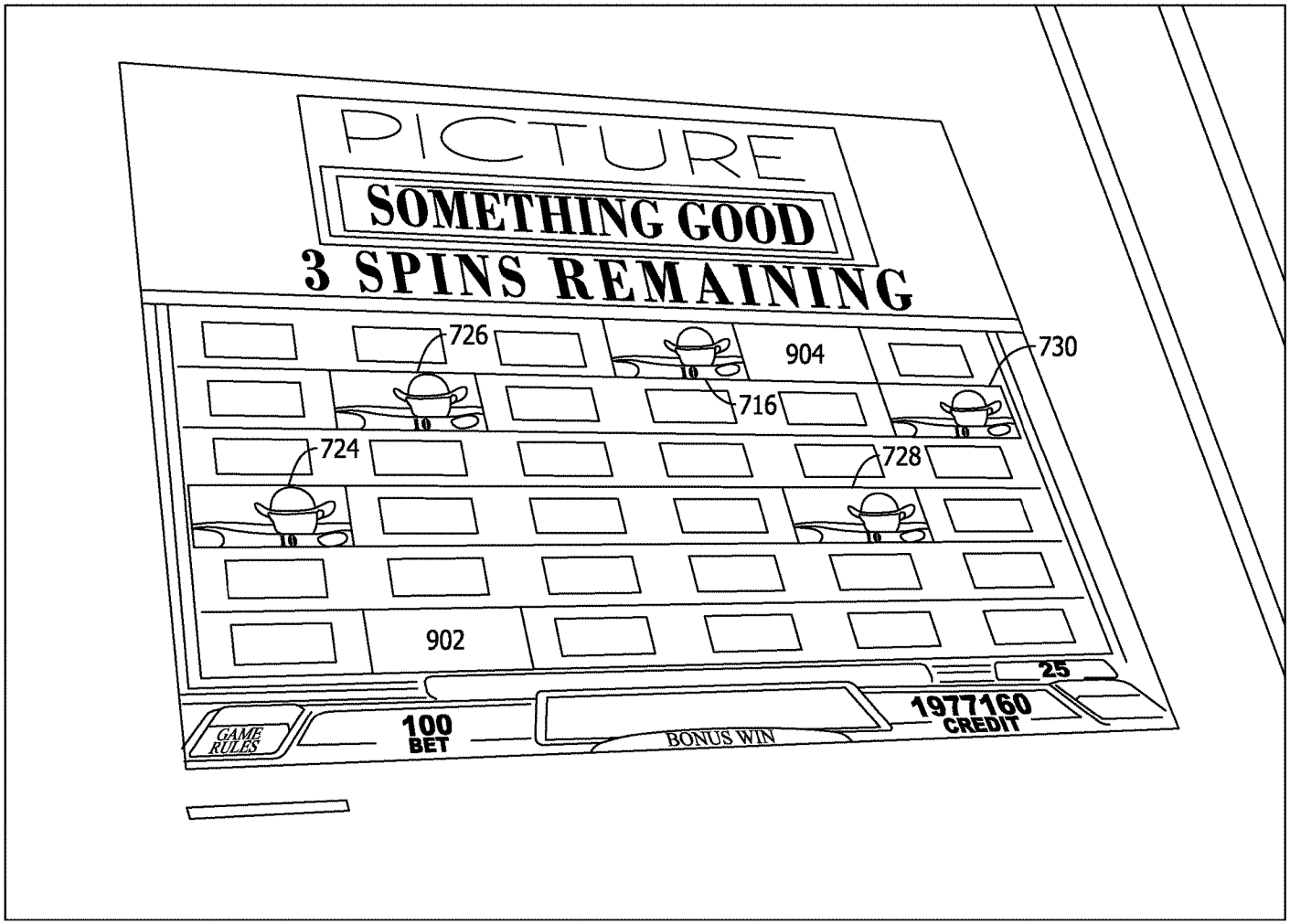
FIG. 9 is an exemplary screenshot that may be displayed in which a second plurality of symbol display positions are selected.

Further, as shown with reference to FIG. 8, game controller 60 may also display 606 a symbol, such as symbol 802, in each of selected symbol display positions 716 and 724-730. Symbol 802 may include any suitable symbol, such as, for example, and as shown, an image that is associated with a game theme or a bonus game theme. Symbol 802 may, in addition, be selected from a group of possible or available symbols, such that each selected symbol display position 716 and 724-730 displays a symbol from the group of available symbols. However, in some embodiments, and as shown, each selected symbol display position 716 and 724-730 may display an identical symbol 802.

In the exemplary embodiment, game controller 60 may evaluate 608 selected first plurality of symbol display positions 716 and 724-730 to determine 610 whether any of the selected first plurality of symbol display positions are vertically and/or horizontally adjacent. If any selected symbol display positions are vertically and/or horizontally adjacent, game controller 60 may determine 610 which adjacent symbol display positions to merge (described in more detail below).

However, if none of the selected first plurality of symbol display positions 716 and 724-730 are adjacent to another one of the selected first plurality of symbol display positions 716 and 724-730, game controller 60 may not merge any of the symbol display positions of the selected first plurality of symbol display positions. Rather, as shown with reference to FIGS. 6 and 9, if there are spins remaining 614, game controller 60 may select 604 a second plurality of symbol display positions, such as second plurality of symbol display positions 902 and 904. As described above, each of the selected second plurality of symbol display positions may be associated with one or more credit values.

In response to selecting the second plurality of symbol display positions 902 and 904, game controller 60 may, as described above, display 606 a symbol in each of the selected second plurality of symbol display positions 902 and 904, evaluate 608 each of the selected first plurality of symbol display positions 716, 724-730, 902, and 904, determine 610 which selected symbol display positions 716, 724-730, 902, and 904, if any, to merge based upon the relative locations between each of the selected symbol display positions 716, 724-730, 902, and 904, and/or merge 612 selected adjacent symbol display positions.

Figure 10:
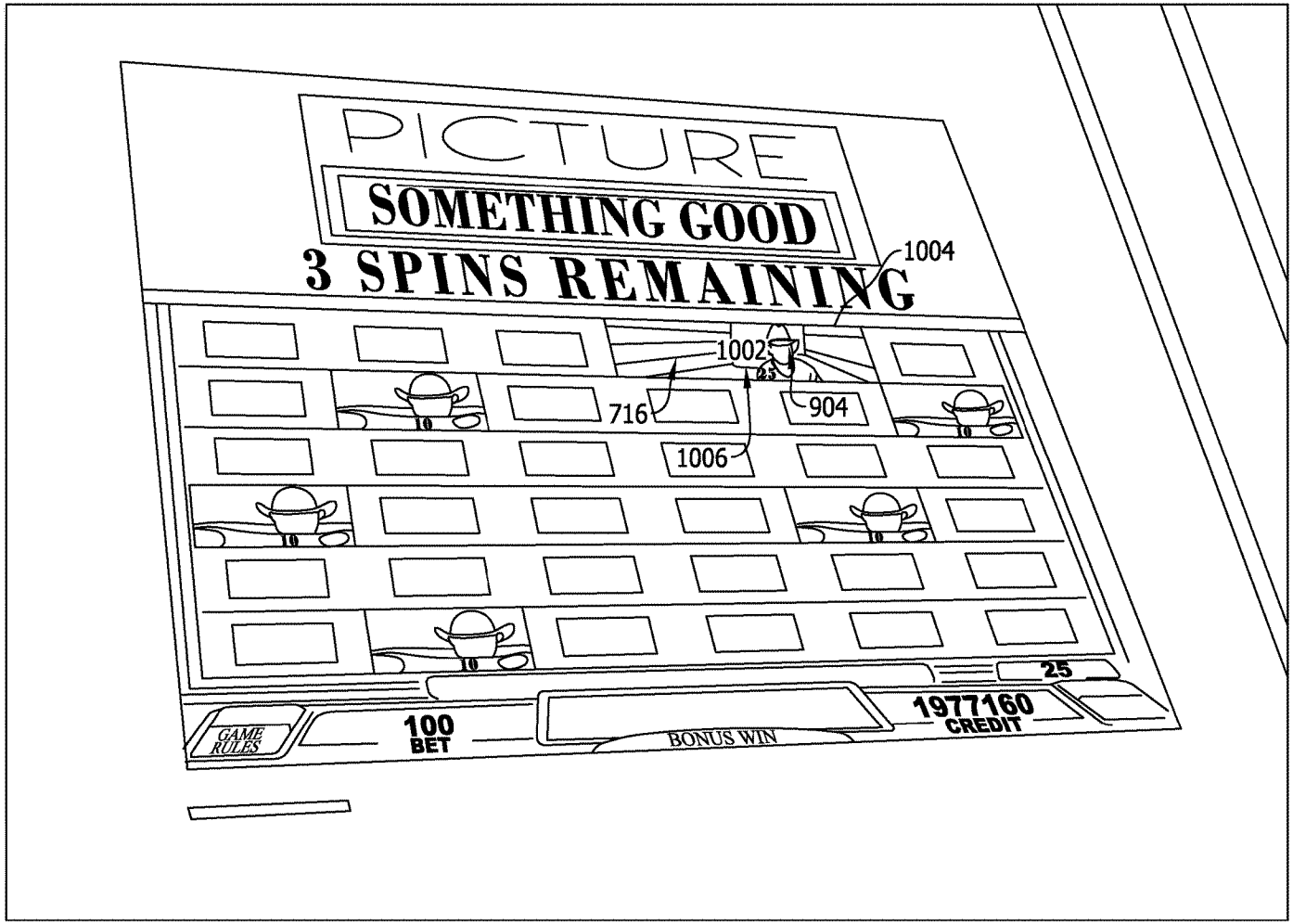
FIG. 10 is an exemplary screenshot that may be displayed in which adjacent selected symbol display positions are merged.

A merged symbol display position 1002, which includes two selected, adjacent, symbol display positions 716 and 904, is shown in FIG. 10. Merged symbol display position 1002 includes a merged symbol display position symbol 1004, which may be different from and/or the same as symbol 802 (described above). Symbol 1004 is physically large enough, however, to span both of merged symbol display positions 716 and 904. Thus, merged symbol display position 1002 and merged symbol 1004 are larger than the remaining unmerged symbol display positions and symbols. Merged symbol display position 1002 and/or merged symbol 1004 may, in addition, be associated with a particular credit value 1006. Value 1006 may be any suitable value, such as twenty-five credits. In some embodiments, value 1006 may be greater than the value associated with unmerged selected symbol display positions and/or symbols.

As described above, game controller 60 may determine 610 which adjacent selected symbol display positions to merge. More particularly, when multiple combinations of adjacent symbol display positions exist, game controller 60 may calculate a game award for all, or a subset of all, possible combinations of merged symbol display positions.

For example, game controller 60 may calculate a plurality of possible game awards for one or more combinations of adjacent symbol display positions. Game controller 60 may also evaluate or compare each of the calculated game awards, and based upon the evaluation or comparison, game controller 60 may select the combination of adjacent symbol display positions that yields the greatest, or maximum, possible game award based on the symbols displayed. Game controller 60 may, in addition, unmerge a plurality of merged symbol display positions, such that one or more unmerged symbol display positions are available for merger with one or more other adjacent symbol display positions. Thus, game controller 60 may iterate through all, or a subset of all, possible symbol position merges and unmerges, game outcomes and/or game awards, to facilitate the player receiving an optimal or maximum game award. An exemplary process for selecting the combination of adjacent symbol display positions yielding the maximum possible game award is described below with reference to FIG. 14.

Figure 11:
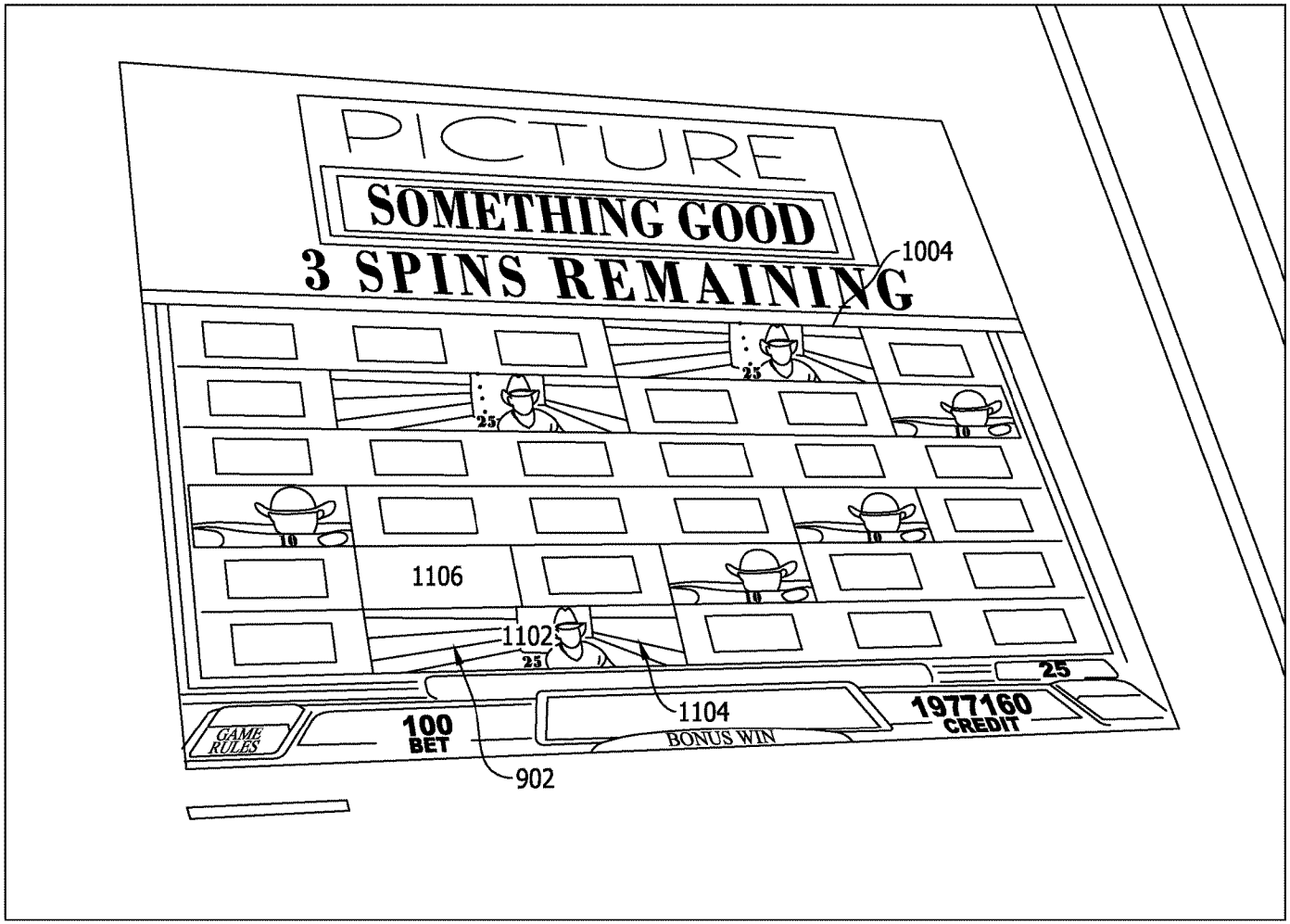
FIG. 11 is a screenshot of an exemplary embodiment in which a third symbol display position is selected.
Figure 12:
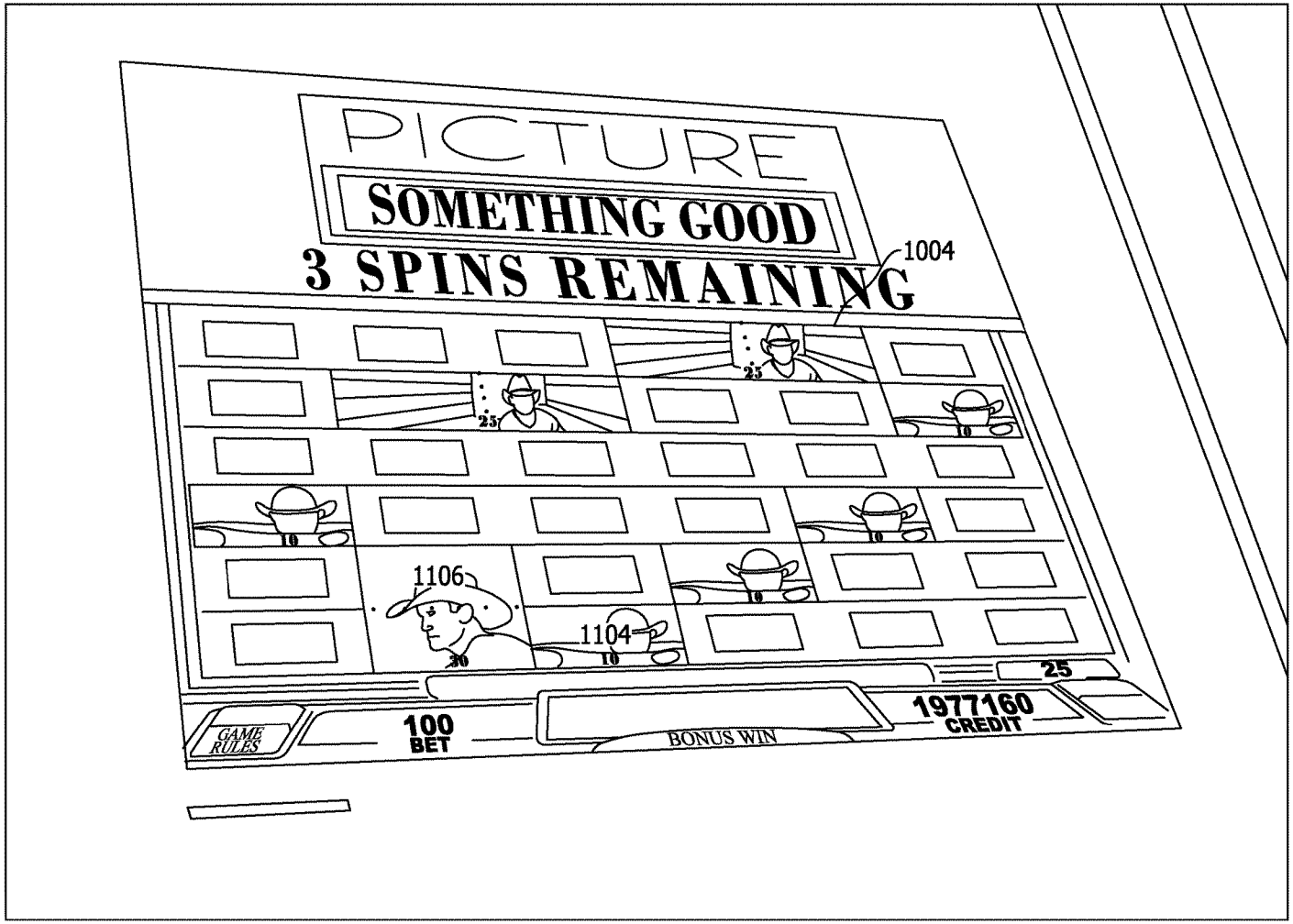
FIG. 12 is an exemplary screenshot that may be displayed in which adjacent selected symbol display positions are unmerged and remerged based on the selected third symbol display position shown in FIG. 11.

With reference to FIGS. 11 and 12, exemplary screenshots 1100 and 1200 are shown in which an additional symbol display position is selected, and in which a plurality of previously merged adjacent symbol display positions are unmerged and remerged based upon the additional selected symbol display position. Specifically, at screenshot 1100, a merged symbol display position 1102 is illustrated. Merged symbol display position 1102 has been, in this example, generated by game controller 60 during a previous bonus game round. Merged symbol display position 1102 includes selected symbol display positions 902 and 1104. During gameplay, and as illustrated, game controller 60 selects 604 a third symbol display position 1106. Game controller 60 evaluates 608 all of the selected symbol display positions (merged and unmerged), including symbol display positions 902, 1104, and 1106, and determines 610 which symbol display positions to unmerge and/or merge based upon a comparison of all possible game outcomes and/or awards that would result from each combination of unmerged and/or merged symbol display positions (as described above).

In some embodiments, game controller 60 may not compare all possible game outcomes and/or game awards. Rather, game controller 60 may randomly select a first group of adjacent selected symbol display positions for possible merger. Game controller 60 may evaluate the remaining adjacent selected symbol display positions for merge and/or unmerge operations as well, and based upon the evaluation, game controller 60 may select an optimal combination of merge and/or unmerge operations. Thus, in one embodiment, game controller 60 may evaluate 608 a limited set, or a subset, of all possible selected symbol combinations proceeding from a starting point represented by a first randomly selected combination of merged symbol display positions. One technical effect of such an embodiment is that gameplay may proceed at a more rapid pace, because every possible combination of adjacent symbol display positions is not considered. Another technical effect of such an embodiment is that evaluation of a subset of all possible symbol display position combinations further reduces the processing requirements placed on game controller 60, which may improve the performance of game controller 60.

In this instance, and with reference to FIG. 12, game controller 60 determines that a maximum or optimal game award and/or game outcome may be achieved by unmerging, based on the symbols displayed, symbol display positions 902 and 1104, such that symbol display position 902 is available to be merged with adjacent symbol display position 1106. Thus, game controller 60 unmerges symbol display positions 902 and 1104 and merges symbol display positions 902 and 1106. Symbol display position 1104 is displayed as a single, unmerged, selected symbol display position, and its credit value is recalculated accordingly.

Method 600 may continue in the manner described above until there are no spins remaining in the bonus game, at which point game controller 60 may generate a final game outcome, based upon the final combination of merged and non-merged selected symbol display positions. For example, each selected symbol display position, including each set of merged symbol display positions, may be associated with a credit value (as described above). Game controller may add each credit value to calculate a total or sum representing the total game award or the total number of credits awarded as a result of the bonus game. Game controller 60 may further, in some embodiments, apply a multiplier, or multiplication factor, to the total number of credits awarded as a result of the base game.

Figure 13:
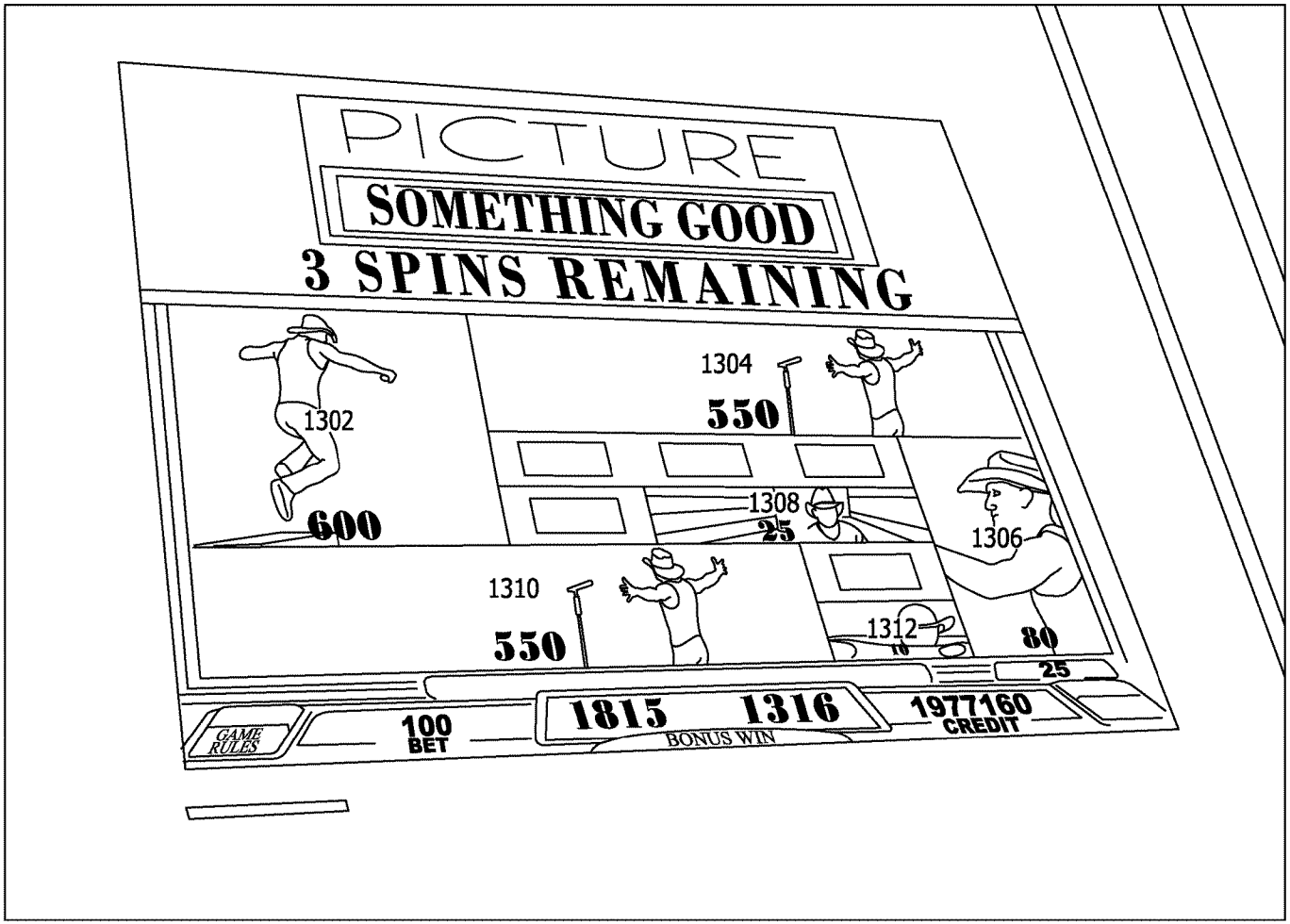
FIG. 13 is an exemplary screenshot that may be displayed in which a final game outcome is displayed.

An exemplary final game outcome is illustrated in FIG. 13. In the exemplary embodiment, the final game outcome includes a first group of merged symbol display positions 1302, a second group of merged symbol display positions 1304, a third group of merged symbol display positions 1306, a fourth group of merged symbol display positions 1308, and a fifth group of merged symbol display positions 1310. The final game outcome also includes a single selected (non-merged) symbol display position 1312, and a plurality of non-selected symbol display positions 1314. Each group of merged symbol display positions 1302-1310 is associated with a credit value, such as, for example, six hundred credits, five hundred and fifty credits, eighty credits, twenty five credits, and five hundred and fifty credits, respectively. As described above, the credit value associated with each merged symbol display position 1302-1310 is, in the exemplary embodiment, equal to the sum of each of the symbol display positions combined to form a respective merged symbol display position 1302-1310. Non-merged symbol display position 1312 is also associated with a credit value, such as, for example, a credit value of ten credits. Game controller 60 may sum each credit value to calculate a total game award, which is displayed, in this example, in the amount of one thousand eight hundred and fifteen credits, on a bonus meter 1316 of display 14.

As described above, the final game outcome illustrated in FIG. 13 is the result of many spins, at least some of which resulted in various merge and unmerge operations. Further, as described above, game controller 60 performs each merge and/or unmerge operation during game play to generate an optimal and/or maximum total game outcome and/or a maximum or optimal total game award based on the symbols displayed. In some embodiments, game controller 60 may, based upon a series of symbol selections occurring during the bonus game, merge every symbol display position shown on display 14. In such an instance, game controller 60 may display a single, large, symbol (not shown) over the entire area of the single merged symbol display position and, in addition, may generate a jackpot award based upon the selection of every symbol display position.

Figure 14:
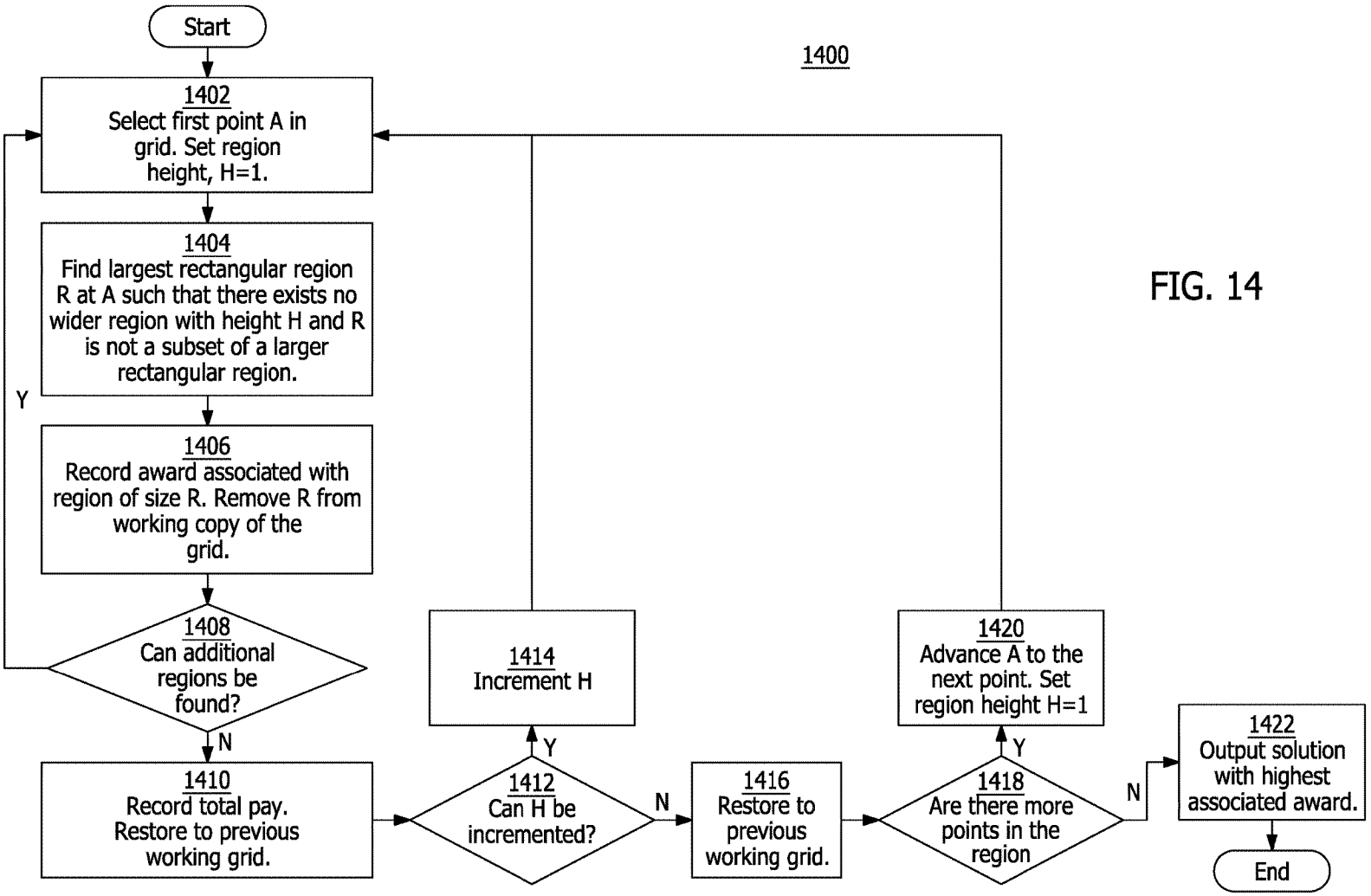
FIG. 14 is a flowchart of an exemplary method for selecting a combination of adjacent symbol display to identify an optimal game award.

With reference to FIG. 14, an exemplary process 1400 for selecting a combination of adjacent symbol display positions to identify an optimal game award is shown. Initially, a starting point, which may be labeled as "A," is selected 1402 and a region height, "H," may be set to initial values by controller 60. In the exemplary embodiment, an initial height value may be set to "1," such that H=1. The starting point may correspond to an upper left corner of a selected symbol display position. In the exemplary embodiment, a topmost, leftmost, symbol display position may be selected as an initial starting point. However, in various embodiments, any symbol display position, such as a bottommost, rightmost, symbol display position may be selected as a starting point.

Having selected a symbol display position as a starting point, controller 60 may determine 1404 a largest rectangular region, "R," at starting point, A, such that there exist no wider regions at starting point, A, with height, H, and such that region, R, is not a subset of a larger rectangular region. Controller 60 may, in addition, record or store 1406 an award or value associated with region, R, and region, R, may be removed from further consideration, such as from a working copy of the grid, which may be generated and stored by controller 60 for evaluation purposes. For example, in some embodiments, the region, R, may be removed, or masked, from the working copy of the grid. During the evaluation process, controller 60 may ensure that the upper left corner of region, R, is associated with starting point, A, as well as that region, R, is at least as tall as the value currently associated with height, H, and that no wider rectangular region extends from starting point, A, with a height of H. Controller 60 may also ensure that the rectangular region is as tall as possible at a selected width, W, as well as that region, R, is not a subset of a larger rectangular region associated with a different starting point.

Next, controller 60 may determine 1408 whether additional regions may be evaluated. In general, width, W, may be incremented until the value associated with width, W, is equal to the number of columns of reel strips displayed by controller 60. If width, W, can be incremented, controller 60 may increment width, W, by one symbol display position, and process 1400 returns to block 1402. If, on the other hand, width, W, cannot be further incremented, controller 60 records 1410, or stores, the award associated with the largest rectangular region, R, or group of adjacent symbol display positions and determines whether height, H, can be incremented 1412. In general, height, H, may be incremented until the value associated with width, W, is equal to the number of rows of reel strips display by controller 60. If height, H, can be incremented, controller 60 may increment 1414 H by a value of "1" and process 1400 may return to block 1404.

If, on the other hand, height, H, cannot be incremented further, controller 60 may restore 1416 to the previous copy of the working grid and determine 1418 whether there are more starting points in region, R. For example, controller 60 may determine whether starting point, A, may be incremented. In general, A can be incremented until each symbol display position displayed by controller 60 on each of the reel strips has been used as a starting point. If starting point, A, can be incremented from its previous position, controller advances or increments 1420 A by a value of one symbol display position and process 1400 returns to block 1404. If, on the other hand, A cannot be advanced or incremented further, controller 60 outputs 1422 a solution associated with a highest award. For example, controller 60 may compare each of the stored awards and select for output the group of symbol display positions associated with the greatest award. This group of symbol display positions is, in addition, merged, as described above, in display 14. Symbol display positions that are merged by controller 60 may also be unmerged from previous combinations of symbol display positions, as described in greater detail above.

Embodiments of the gaming machines and systems, as described above, facilitate play of a bonus game in which one or more adjacent symbols are merged and/or unmerged based upon their relative positions with respect to one another. Embodiments further provide for optimal merge and unmerge operations during game play, to facilitate distribution of an optimal award to a player during the game. Hence, the gaming machines and systems described herein facilitate a new and exciting bonus game in which a player receives a bonus award based upon various merge and unmerge operations performed between adjacent symbols.

Embodiments of the systems and methods of electronic gaming, as described above, therefore facilitate a game or bonus game in which a plurality of symbol display positions are selected, evaluated, merged, and/or unmerged to generate an optimal and/or maximum game outcome and/or game award. Selected symbol display positions may be merged with and/or unmerged from other, adjacent, selected symbol display positions during gameplay, such that an optimal and/or maximum game award is always represented or displayed during gameplay.

As indicated above, the method may be embodied in program code. The program code could be supplied in a number of ways, for example on a tangible computer readable storage medium, such as a disc or a memory device, e.g. an EEPROM, (for example, that could replace part of memory 103) or as a data signal (for example, by transmitting it from a server). Further different parts of the program code can be executed by different devices, for example in a client server relationship. Persons skilled in the art, will appreciate that program code provides a series of instructions executable by the processor.

Exemplary embodiments of a system, method, and article of manufacture for electronic gaming and related components are described above in detail. The disclosure is not limited to the specific embodiments described herein, but rather, components of the systems and/or articles and/or steps of the methods may be utilized independently and separately from other components and/or steps described herein. For example, the configuration of components described herein may also be used in combination with other processes, and is not limited to practice with the systems, articles, and related methods as described herein. Rather, the exemplary embodiment can be implemented and utilized in connection with many applications in which a game or bonus game is desired.

Although specific features of various embodiments of the present disclosure may be shown in some drawings and not in others, this is for convenience only. In accordance with the principles of the present disclosure, any feature of a drawing may be referenced and/or claimed in combination with any feature of any other drawing.

This written description uses examples to disclose the embodiments of the present disclosure, including the best mode, and also to enable any person skilled in the art to practice the disclosure, including making and using any devices or systems and performing any incorporated methods. The patentable scope of the embodiments described herein is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method of electronic gaming implemented using a gaming system, the gaming system including a display configured to display a wagering game, a player input interface, a credit input mechanism including at least one of a card reader, a ticket reader, a bill acceptor, or a coin input mechanism, the credit input mechanism configured to establish a credit balance that is increasable and decreasable based on wagering activity, a tangible, non-transitory, computer-readable memory, and a game controller communicatively coupled to the memory, the method comprising:

identifying, by the game controller, a first combination of adjacent symbol display positions in a matrix of symbol display positions and a second combination of adjacent symbol display positions in the matrix of symbol display positions, the matrix of symbol display positions defined by a plurality of reel strips, each symbol display position in the matrix of symbol display positions displaying a symbol from a reel strip of the plurality of reel strips;

evaluating, by the game controller, the symbols in the first combination of adjacent symbol display positions to calculate a first game award;

evaluating, by the game controller, the symbols in the second combination of adjacent symbol display positions to calculate a second game award;

determining, by the game controller, which of the first game award and the second game award is larger;

merging, by the game controller one of: i) the first combination of adjacent symbol display positions or ii) the second combination of adjacent symbol display positions, wherein the first combination of adjacent symbol display positions are merged if the first game award is larger than the second game award, and wherein the second combination of adjacent symbol display positions are merged if the second game award is larger than the first game award;

generating, by the game controller, a game outcome based upon the merging; and providing, by the game controller, a game award based upon the game outcome.

2. The method of claim 1, wherein merging the first combination of symbol display positions further comprises merging, by the game controller, at least three adjacent symbol display positions to generate a merged symbol display position.

3. The method of claim 2, further comprising displaying, by the game controller, a single symbol in the merged symbol display position.

4. The method of claim 1, further comprising:

identifying, by the game controller, a third combination of adjacent symbol display positions in the matrix of symbol display positions; and merging, by the game controller one of i) the first combination of adjacent symbol display positions, ii) the second combination of adjacent symbol display positions, or iii) the third combination of adjacent symbol display positions.

5. The method of claim 4, further comprising:

identifying, by the game controller, which of the first combination of adjacent symbol display positions, the second combination of adjacent symbol display positions, or the third combination of adjacent symbol display positions is associated with a maximum game award; and merging, by the game controller, the combination of adjacent symbol display positions associated with the maximum game award.

6. The method of claim 1, further comprising unmerging, by the game controller, at least two adjacent symbol display positions of one of: i) the first combination of adjacent symbol display positions or ii) the second combination of adjacent symbol display positions.

7. The method of claim 1, further comprising:

determining, by the game controller, which of the first combination of adjacent symbol display positions or the second combination of adjacent symbol display positions is associated with a lesser game award; and unmerging, by the game controller, the adjacent symbol display positions of the one of the first combination of adjacent symbol display positions or the second combination of adjacent symbol display positions that is associated with the lesser game award.

8. An electronic gaming system comprising:

a display;

a player input interface;

a credit input mechanism;

a game controller configured to execute instructions stored on a tangible, non-transitory, computer-readable memory, which, when executed by the game controller, cause the game controller to at least:

identify a first combination of adjacent symbol display positions in a matrix of symbol display positions and a second combination of adjacent symbol display positions in the matrix of symbol display positions, the matrix of symbol display positions defined by a plurality of reel strips, each symbol display position in the matrix of symbol display positions displaying a symbol from a reel strip of the plurality of reel strips;

evaluate the symbols in the first combination of adjacent symbol display positions to calculate a first game award;

evaluate the symbols in the second combination of adjacent symbol display positions to calculate a second game award;

determine, by the game controller, which of the first game award and the second game award is larger;

merge, one of: i) the first combination of adjacent symbol display positions or ii) the second combination of adjacent symbol display positions, wherein the first combination of adjacent symbol display positions are merged if the first game award is larger than the second game award, and wherein the second combination of adjacent symbol display positions are merged if the second game award is larger than the first game award;

generate, by the game controller, a game outcome based upon the merging; and provide, by the game controller, a game award based upon the game outcome.

9. The system of claim 8, wherein merging the first combination of symbol display positions further comprises merging at least three adjacent symbol display positions to generate a merged symbol display position.

10. The system of claim 9, wherein the instructions, when executed by the game controller, further cause the game controller to display a single symbol in the merged symbol display position.

11. The system of claim 8, wherein the instructions, when executed by the game controller, further cause the game controller to:

identify a third combination of adjacent symbol display positions in the matrix of symbol display positions; and merge one of: i) the first combination of adjacent symbol display positions, ii) the second combination of adjacent symbol display positions, or iii) the third combination of adjacent symbol display positions.

12. The system of claim 11, wherein the instructions, when executed by the game controller, further cause the game controller to:

identify which of the first combination of adjacent symbol display positions, the second combination of adjacent symbol display positions, or the third combination of adjacent symbol display positions is associated with a maximum game award; and merge the combination of adjacent symbol display positions associated with the maximum game award.

13. The system of claim 8, wherein the instructions, when executed by the game controller, further cause the game controller to:

unmerge least two adjacent symbol display positions of one of: i) the first combination of adjacent symbol display positions or ii) the second combination of adjacent symbol display positions.

14. The system of claim 8, wherein the instructions, when executed by the game controller, further cause the game controller to:

determine which of the first combination of adjacent symbol display positions or the second combination of adjacent symbol display positions is associated with a lesser game award; and unmerge the adjacent symbol display positions of the one of the first combination of adjacent symbol display positions or the second combination of adjacent symbol display positions that is associated with the lesser game award.

15. An article of manufacture including a non-transitory, tangible, computer readable storage medium having instructions stored thereon that, in response to execution by a game controller configured for electronic gaming, cause the game controller to at least:

identify a first combination of adjacent symbol display positions in a matrix of symbol display positions and a second combination of adjacent symbol display positions in the matrix of symbol display positions, the matrix of symbol display positions defined by a plurality of reel strips, each symbol display position in the matrix of symbol display positions displaying a symbol from a reel strip of the plurality of reel strips;

evaluate the symbols in the first combination of adjacent symbol display positions to calculate a first game award;

evaluate the symbols in the second combination of adjacent symbol display positions to calculate a second game award;

determine which of the first game award and the second game award is larger;

merge one of: i) the first combination of adjacent symbol display positions and ii) the second combination of adjacent symbol display positions, wherein the first combination of adjacent symbol display positions are merged if the first game award is larger than the second game award, and wherein the second combination of adjacent symbol display positions are merged if the second game award is larger than the first game award;

generate a game outcome based upon the merging; and provide a game award based upon the game outcome.

16. The article of claim 15, wherein merging the first combination of adjacent symbol display positions further merging the at least three adjacent symbol display positions to generate a merged symbol display position.

17. The article of claim 16, wherein the instructions, when executed by the game controller, further cause the game controller to display a single symbol in the merged symbol display position.

18. The article of claim 15, wherein the instructions, when executed by the game controller, further cause the game controller to:

identify a third combination of adjacent symbol display positions in the matrix of symbol display positions; and merge one of: i) the first combination of adjacent symbol display positions, ii) the second combination of adjacent symbol display positions, or iii) the third combination of adjacent symbol display positions.

19. The article of claim 18, wherein the instructions, when executed by the game controller, further cause the game controller to:

identify which of the first combination of adjacent symbol display positions, the second combination of adjacent symbol display positions, or the third combination of adjacent symbol display positions is associated with a maximum game award; and merge the combination of adjacent symbol display positions associated with the maximum game award.

20. The article of claim 15, wherein the instructions, when executed by the game controller, further cause the game controller to:

unmerge at least two adjacent symbol display positions of one of: i) the first combination of adjacent symbol display positions or ii) the second combination of adjacent symbol display positions.

21. The article of claim 15, wherein the instructions, when executed by the game controller, further cause the game controller to:

determine which of the first combination of adjacent symbol display positions or the second combination of adjacent symbol display positions is associated with a lesser game award; and unmerge the adjacent symbol display positions of the one of the first combination of adjacent symbol display positions or the second combination of adjacent symbol display positions that is associated with the lesser game award.

* * * * *